United States Patent [19]

Faulconer, Jr.

[11] 4,169,435

[45] Oct. 2, 1979

[54] INTERNAL COMBUSTION ENGINE AND METHOD

[76] Inventor: Edward L. Faulconer, Jr., Rte. 4, Box 160, Greensboro, N.C. 27405

[21] Appl. No.: 809,187

[22] Filed: Jun. 23, 1977

[51] Int. Cl.[2] ..... F02B 75/04

[52] U.S. Cl. ..... 123/48 A; 123/64; 123/78 A

[58] Field of Search ..... 123/78 A, 48 A, 51 AA, 123/47 R, 47 A, 51 B, 51 BD, 64, 66

[56] References Cited

U.S. PATENT DOCUMENTS

| | | | |
|---|---|---|---|
| 851,176 | 4/1907 | Lippincott | 123/78 A |
| 1,075,307 | 10/1913 | Shively | 123/78 A |
| 1,707,005 | 3/1929 | Hall | 123/48 A |
| 2,382,362 | 8/1945 | Weinreb | 123/78 A |
| 2,431,859 | 12/1947 | Fisher | 123/47 A |
| 2,445,148 | 7/1948 | Minnix | 123/66 |
| 3,254,636 | 6/1966 | Faust | 123/78 A |
| 3,312,206 | 4/1967 | Radovic | 123/48 A |
| 3,741,175 | 6/1973 | Rouger | 123/48 A |

*Primary Examiner*—Ira S. Lazarus

*Attorney, Agent, or Firm*—Bell, Seltzer, Park & Gibson

[57] ABSTRACT

An internal combustion engine and a method of operating such an engine in which a power piston and a control piston move within a cylinder for defining between the pistons a combustion chamber. Charges of gas are drawn into an intake chamber defined within the cylinder by the control piston and are then transferred through the control piston into the combustion chamber where the charge is compressed and burned to deliver power from the engine through the power piston. In accordance with the present invention, the combustion chamber is maintained at a substantially constant volume during a combustion stroke of the power piston and as power is delivered from the engine.

18 Claims, 9 Drawing Figures

INTERNAL COMBUSTION ENGINE AND METHOD

Internal combustion engines have been the subject of intensive and extensive development, and have fallen generally into two broad classifications based upon cyclic operation. Four stroke cycle engines are well known for certain uses, such as for automotive vehicles and the like, and deliver power through a power piston on alternate strokes from a top dead center position to a bottom dead center position. The method of operation of a four stroke cycle internal combustion engine comprises the steps of drawing a charge of gas into a combustion chamber during an intake stroke of the power piston, compressing the charge in the combination chamber during a compression stroke, burning the charge and transmitting power from the piston during a power stroke, and forcing products of combustion from the cylinder during an exhaust stroke.

Two stroke cycle internal combustion engines are also well known, for uses such as small or fractional horsepower devices, and accomplish delivery of power on each stroke of a piston from a top dead center position to a bottom dead center position. The method of operating a two stroke cycle internal combustion engine comprises the steps of directing a charge of gas into a combustion chamber simultaneously with scavaging of exhaust gases therefrom during movement of a power piston to and about a bottom dead center position, compressing the charge during a compression stroke, and burning the charge while transmitting power during a power stroke. Exhaust of products to combustion and intake of a charge of gas occur during the transition from the power stroke into the compression stroke.

It has been proposed heretofore that engines operating substantially on a four stroke cycle method might be constructed so as to transmit power through a power piston on each stroke thereof from top dead center position to bottom dead center position. Certain such proposals have relied upon the use of a pair of piston members moving within a common cylinder. The pistons define therebetween, and with the cylinder, a combustion chamber into which charges of gas are transferred for burning and delivery of power. One of the pistons functions as a power piston in delivering power through a crankshaft, while the other functions to improve the exhausting and intake functions typical of a two cycle engine. That is, on completion of a power stroke during which the volume of the combustion chamber is expanded, the secondary piston is moved rapidly toward the power piston so as to force exhaust gases from the combustion chamber. Before the compression stroke of the power piston, the secondary piston is moved quickly away from the power piston, transferring into the combustion chamber a charge of gas which had been drawn into an intake chamber defined by the cylinder and the secondary piston.

While such approaches have achieved the desirable two stroke cycle delivery of power on each revolution of a crankshaft operatively connected with the power piston while more closely approaching the desirable exhaust and intake characteristics of the four stroke cycle, such engines have failed to achieve significant improvements over operation achievable by more conventional engines.

With the foregoing in mind, it is an object of the present invention to improve the efficiency of internal combustion engines in developing and transmitting driving power. In realizing this object of the present invention, the power capability for given engine sizes is substantially enhanced by maintaining increased pressures on a power piston for extended durations of time through a combustion stroke thereof.

Yet a further object of the present invention is to achieve internal combustion engine operation in accordance with a method by which a combustion chamber is maintained at a substantially constant volume during the burning of a charge of gas and delivery of power therefrom. In realizing this object of the present invention, the control piston in an engine in accordance with the present invention moves from a top dead center position toward a power piston prior to passage of the power piston through its top dead center position. Such relative movement is accomplished by simple harnomic motion of the power piston coordinated with complex motion of the control piston.

Yet a further object of the present invention is to achieve improved volumetric efficiency of an internal combustion engine. In realizing this object of the present invention, the volume of an intake chamber swept by the control piston is greater than the volume of the combustion chamber swept by the combined action of the control piston and power piston. Thus, intake of a charge of gas into the intake chamber is followed by admission of the charge into the combustion chamber at a supercharged pressure above intake chamber pressure.

Some of the objects of the invention having been stated, other objects will appear as the description proceeds, when taken in connection with the accompanying drawings, in which FIG. 1 is an elevation view, in partial section, through an internal combustion engine in accordance with the present invention;

While this invention will be described hereinafter with particular reference to the accompanying drawings, in which the present invention has been illustrated, it is to be understood at the outset of the description which follows that it is contemplated that persons skilled in the appropriate arts may modify the internal combustion engine described hereinafter and achieve the desirable result of this invention. Accordingly, the description which follows is to be understood as a general teaching enabling persons skilled in the appropriate arts to gain the benefit of this invention, and is not to be understood as limiting upon the scope of protection afforded for this invention.

Figure 1:
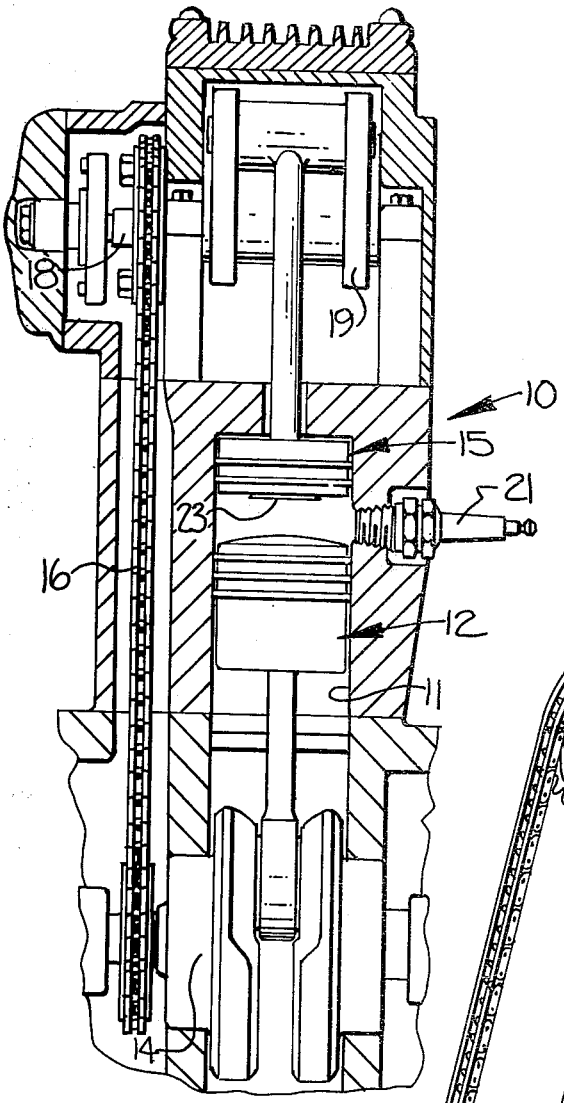
Figure 2:
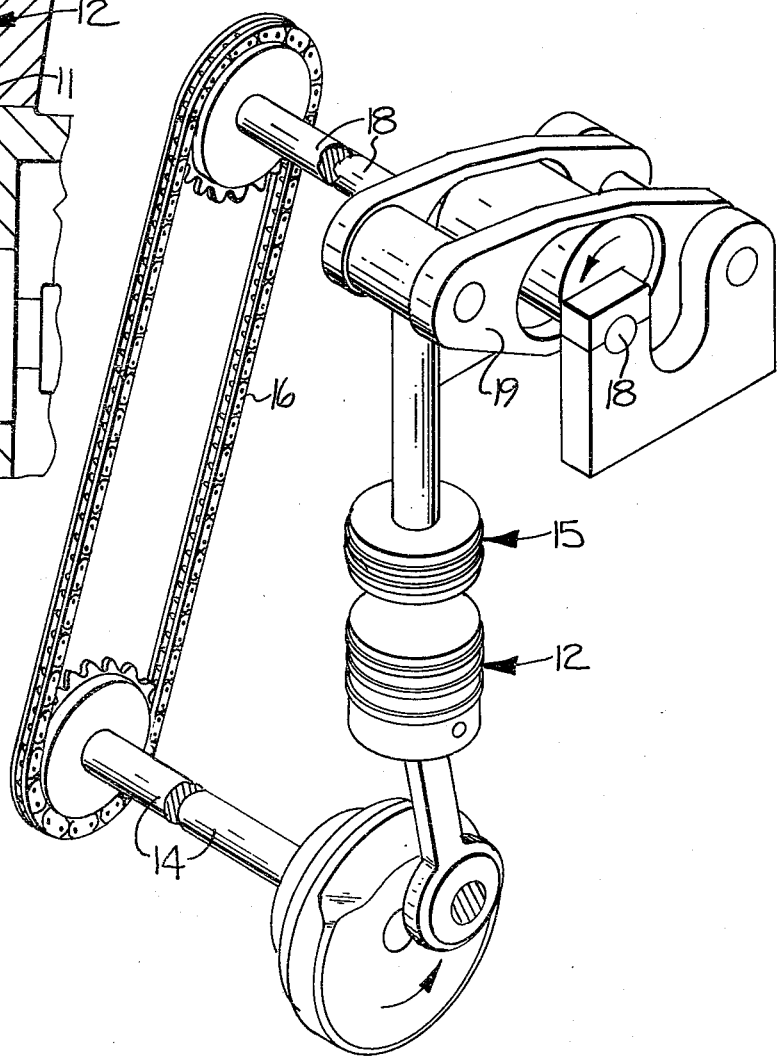
FIG. 2 is a partial perspective view of portions of the engine of FIG. 1, more particularly illustrating certain relationships among operating components of the engine.

Referring now more particularly to the accompanying drawings, the principles of operation of an internal combustion engine constructed in accordance with the present invention will be described with particular reference to a single cylinder engine of spark ignition type indicated generally at 10 (FIG. 1). Persons familar with the construction and operation of internal combustion engines of varying sorts will recognize that such an engine may have a cylinder generally indicated at 11 and contained within appropriate housing and supporting structure. The details of the construction and arrangement of such structure will not here be described, as it is believed that persons skilled in the appropriate arts will be able to understand the construction and operation of such components without the necessity of a full description here. A power piston means generally indicated at 12 is mounted for reciprocation within the cylinder 11 in a compression stroke and a combustion stroke as described more fully hereinafter and is operatively connected with a crankshaft 14 for delivery of power from the engine 10. In accordance with the present invention, the power piston means 12 and crankshaft 14 may be substantially conventional.

In accordance with the present invention, a control piston means generally indicated at 15 is reciprocable in the cylinder 11 in an intake stroke and a transfer stroke as described more fully hereinafter. The control piston means 15 defines with the cylinder 11 an intake chamber and cooperates with the cylinder 11 and the power piston means 12 in defining a combustion chamber, all as described more fully hereinafter. Means, illustrated in the form of a timing chain 16, camshaft 18 and cam following rocker 19, are provided for interconnecting the crankshaft 14 and control piston means 15 for moving the control piston means 15 in a particular manner as pointed out more fully hereinafter.

The general operation of the internal combustion engine 10 in accordance with the present invention includes the steps of drawing a charge of gas into an intake chamber defined within the cylinder 11 by the control piston 15. Suitable intake means operatively communicate with the cylinder 11 for admitting gas into the intake chamber as the control piston means 15 moves (downwardly in the drawings) in an intake stroke. The intake means and means for supplying a charge of combustible gas may take any suitable form known to persons familiar with internal combustion engines and, accordingly, are not here described or shown in great detail. The schematic illustrations of FIGS. 3 through 8 include an intake valve 20 which opens to admit a charge of gas during operation of the engine and as described more fully hereinafter. However, other forms of valving and the like may be employed consistent with prior technology of internal combustion engines as known to appropriately skilled persons and as adapted in light of the disclosure of this invention.

The control piston means 15 additionally cooperates with the power piston means 12 and the cylinder 11 in defining a combustion chamber. More particularly, the combustion chamber comprises a volume within the cylinder 11 between opposing faces of the piston means 12, 15. Suitable means are provided for causing burning of a charge of gas compressed within the combustion chamber by movement of the power piston (upwardly in the drawings) in a compression stroke. In the form illustrated, the ignition means takes the form of a conventional spark plug 21. However, it will be appreciated by persons skilled in the appropriate arts that an internal combustion engine in accordance with this invention may use an ignition of any type known and applicable to other internal combustion engines. Accordingly, both spark ignition and compression ignition as well as any other known form are contemplated as being useful in connection with the engine of this invention.

Exhaust means operatively communicate with the cylinder 11 for venting gaseous products of combustion from the combustion chamber as the power piston 12 completes a combustion stroke. Such exhaust means may take any form known to appropriately skilled persons and is here shown as an exhaust valve 22 disposed adjacent a bottom dead center position of the power piston means 12. Additionally, the engine 10 in accordance with the present invention incorporates transfer means in the control piston means 15 for admitting gas from the intake chamber into the combustion chamber as the control piston means 15 moves (upwardly in the drawings) in a transfer stroke. In the form illustrated, the transfer means takes the form of a transfer poppet valve 23, which opens and closes in response to pressure differentials between gas in the intake and combustion chambers. Both the exhaust valve 22 and transfer valve 23 may be operated by cams or otherwise as known to persons skilled in the appropriate arts.

While the internal combustion engine of the present invention, the operation of which will be described more fully hereinafter, differs in significant regard from prior conventional internal combustion engines of the two stroke cycle and four stroke cycle types, certain terminology developed with reference to such previously known engines is of value in clarifying the operation of the engine of this invention. More particularly, the simple harmonic motion of a piston (such as the power piston means 12 of the engine of this invention) operatively connected with a crankshaft (such as the crankshaft 14 of the engine of this invention) has given rise to terminology identifying "top dead center" and "bottom dead center" positions of a piston. As used heretofore, top dead center position refers to a position of the piston, connecting rod and crankshaft in which the axis of rotation of the crankshaft and the axis of pivotal connection of the connecting rod with the piston and the crankshaft are aligned while the piston is at its furthest distance from the center of rotation of the crankshaft. Similarly, the bottom dead center position is defined as a position in which the axis of rotation and pivotal movement are aligned while the piston is in its position of most close approach to the center of rotation of the crankshaft. Another term used in a conjunction with conventional internal combustion engines is "displacement" meaning the volume swept by a piston in one stroke. As herein used, this terminology will refer both to the power piston means 12 in similarity to conventional internal combustion engine terminology and to the control piston 15, notwithstanding the distinction that the control piston means 15 moves with a complex motion rather than in simple harmonic motion.

With the above discussion as background, it is pertinent to turn to the particular characterizing features of an internal combustion engine in accordance with this invention. As mentioned hereinabove, the means interconnecting the crankshaft 14 and the control piston means 15 move the control piston means with a complex motion. More particularly, the control piston means 15 is moved with the power piston means 12 during a combustion stroke (downward) thereof and maintains the combustion chamber defined between the piston means at substantially constant volume during the combustion stroke. As a consequence, combustion and delivery of power from the charge of gas in the combustion chamber occurs over an extended interval of practically constant volume for the combustion chamber. This is to be distinguished from the operation of a conventional two stroke cycle or four stroke cycle engine in which the interval of essentially constant volume for a combustion chamber is limited to a few degrees of crankshaft rotation to either side of the top dead center position. As a consequence of maintaining the combustion chamber at substantially constant volume during the combustion stroke, greater efficiency is achieved by the engine of the present invention.

The crankshaft 14 and interconnecting means 16, 18, 19 establish a constant phase relationship between movement of the power piston means 12 and control piston means 15 to respective top and bottom dead center positions. This relationship is such that the control piston means 15 is moved to bottom dead center position with, and to top dead center position in advance of, movement of the power piston means to its respective positions. During joint movement of the piston means 12, 15 toward the respective bottom dead center positions, combustion is taking place in the combustion chamber defined therebetween and power is being delivered through the crankshaft 14. Such a stroke of the power piston means 12 is referred to as a combustion stroke, for obvious reasons, while such a stroke of the control piston means 15 is referred to as an intake stroke. Denomination of movement of the control piston means 15 toward its bottom dead center position as being an intake stroke reflects the drawing of a charge of gas into the intake chamber through the intake valve means 20, which operates in timed relation with the intake stroke.

Exhaust of products of combustion occurs during a "dwell" prior to and as the power piston means 12 approaches the bottom dead center position, with the control piston means 15 cooperating at the point for scavaging of substantially all products of combustion through the exhaust valve means 22 which operates in timed relation with the stroke of the power piston means.

Co-directional movement of the power piston means 12 and control piston means 15 toward top dead center positions accomplishes two separate functions, from which the respective strokes take identifying terms. As the control piston moves upwardly from bottom dead center position, a differential in pressure develops between the charge of gas drawn into the intake chamber and the gas retained in the combustion chamber. By reason of such a differential in pressure, the transfer valve means 23 opens and the charge is transferred into the combustion chamber. Thus, movement of the control piston means 15 toward the top dead center position is referred to as a transfer stroke. Subsequent movement of the power piston means 12 toward the top dead center position compresses the charge transferred into the combustion chamber and is hence referred to as a compression stroke.

As will be appreciated from the brief description above, the cycle of operation of the present engine achieves a power output from each combustion stroke of the power piston means 12 toward the bottom dead center position, in general comparison to a two stroke cycle engine. However, the charge of gas is moved successively through cycles of intake, compression, combustion and exhaust in substantial similarity to the method of operation of a four stroke cycle engine.

Figure 3:
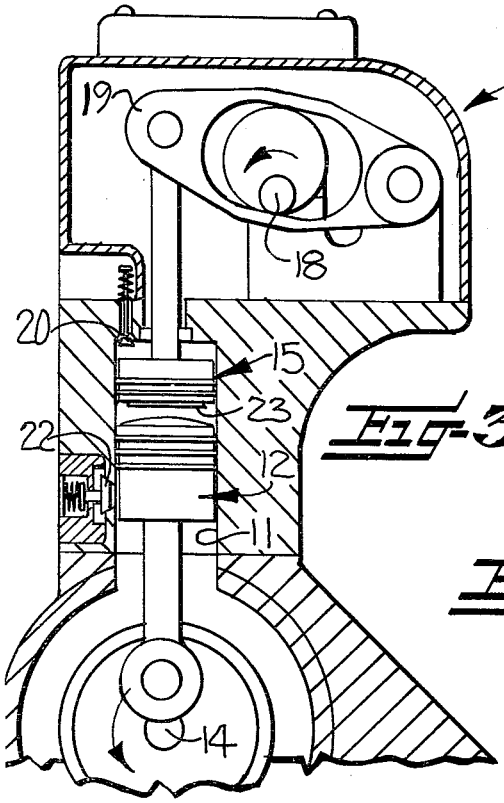
FIG. 3 is a partially schematic side elevation view illustrating certain relationships among the components of the engine of FIGS. 1 and 2.
Figure 4:
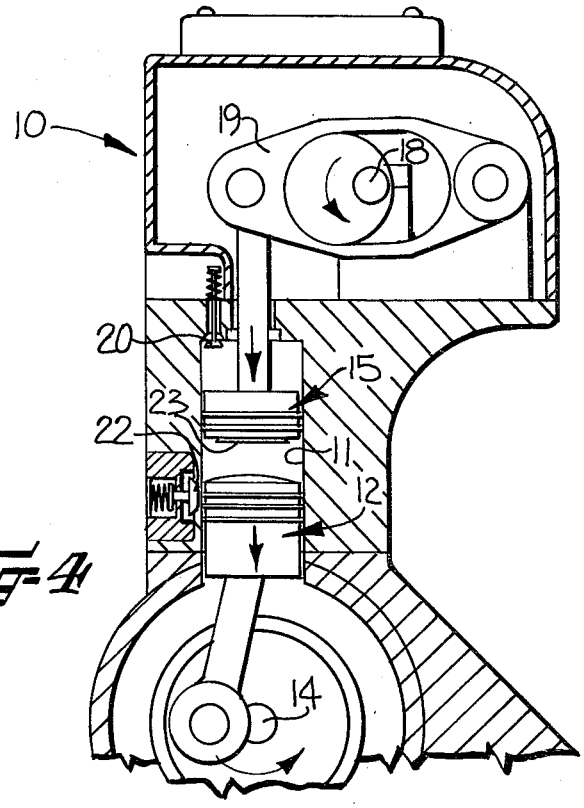
FIGS. 4 through 8 are a sequence of views generally similar to FIG. 3, illustrating certain steps in sequence of operation of the engine in accordance with this invention.
Figure 5:
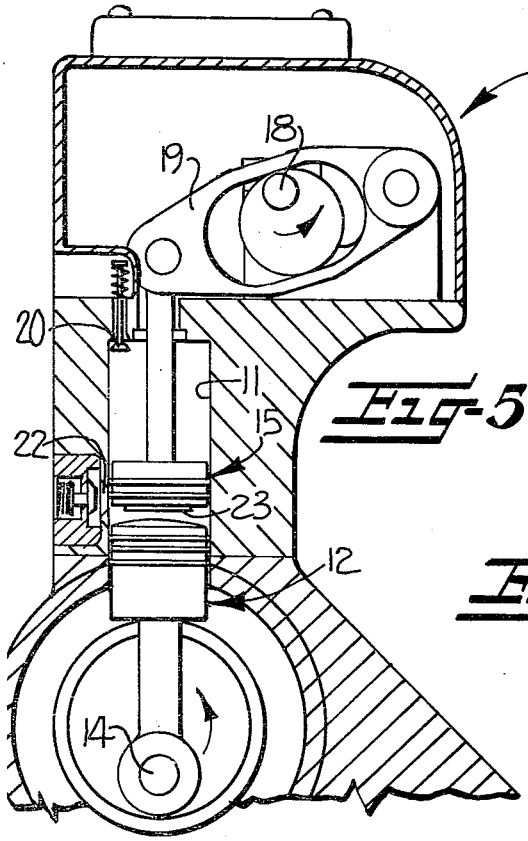
Figure 6:
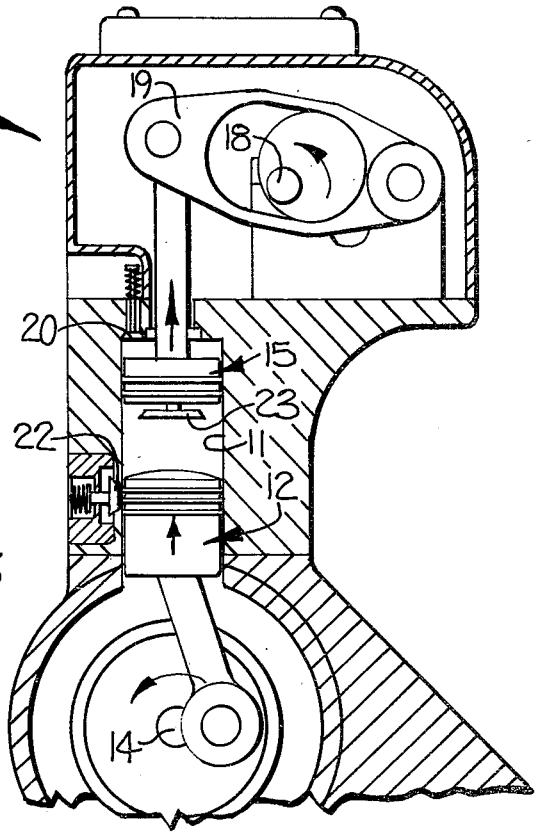
Figure 7:
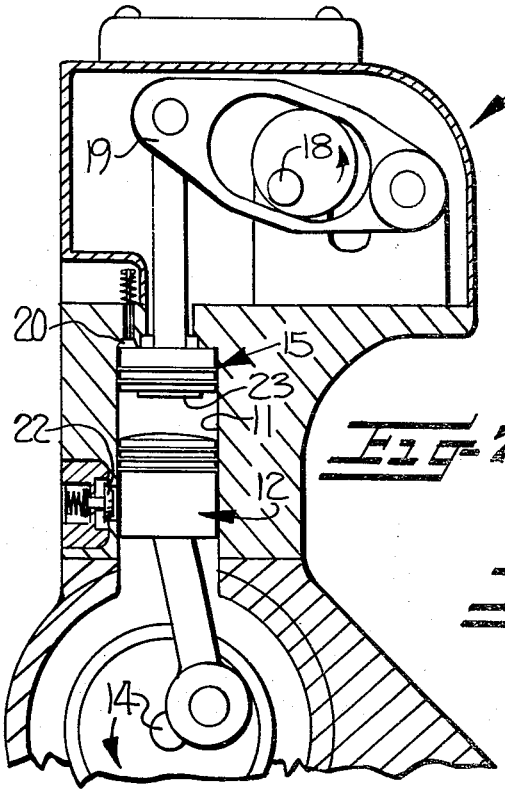
Figure 8:
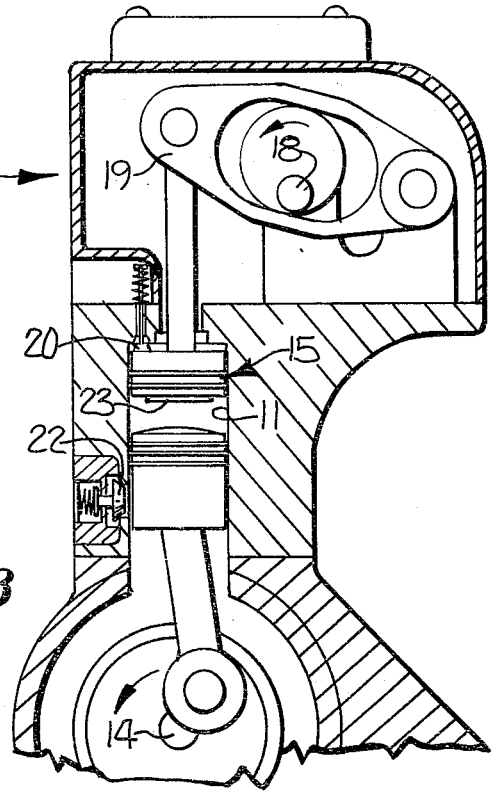
Figure 9:
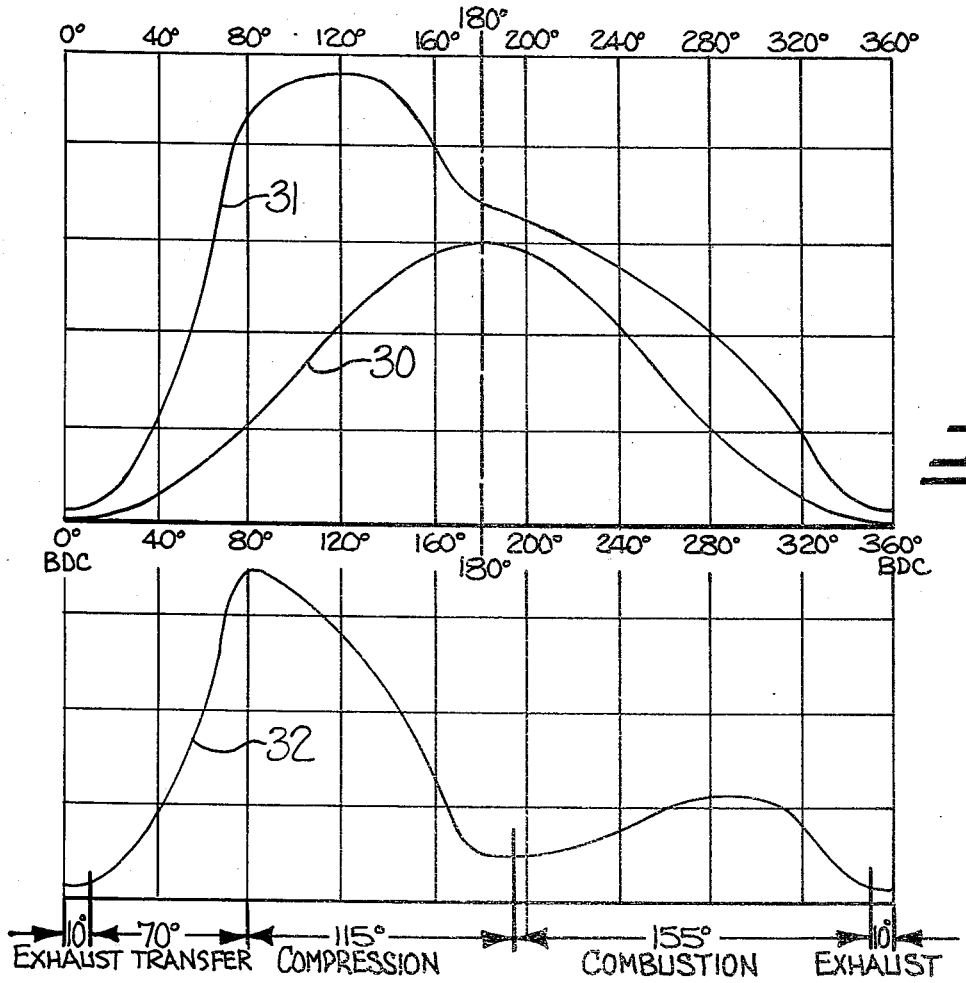
FIG. 9 is a graphical representation of certain characteristics of the operation of the engine of the present invention.

The sequence of operation of the engine of the present invention will become more clear by reference to the sequence of views in FIGS. 3 through 8 and the diagrams of FIG. 9. Referring now more particularly to FIG. 3, the power piston means 12 and control piston means 15 are there shown with the power piston means 12 in top dead center position. The control piston means 15, as pointed out more fully hereinafter, is moving toward the power piston means 12 and is in the intake stroke, drawing a charge of gas into the intake chamber through the intake valve means 20.

As the power piston means 12 moves from top dead center into the combustion stroke (FIG. 4) combustion of the charge within the combustion chamber is initiated by the spark ignition means 21 or in another appropriate manner, and power is delivered from the engine through the crankshaft 14. As the power piston means 12 approaches the bottom dead center position (FIG. 5), an exhaust passageway opens and products of combustion are swept from the combustion chamber by movement of the control piston means 15 to its bottom dead center position as the power piston means reaches its bottom dead center position.

As the power piston means moves to and through its bottom dead center position, the control piston means 15 moves toward its top dead center position, transferring a charge of gas as described hereinabove. It is to be noted that the displacement of the control piston means 15 moving between its top and bottom dead center positions is preferably greater than the displacement of the power piston means 12 moving between its top and bottom dead center positions. By such a relationship of displacements, the control piston means 15 performs an additional function of "supercharging" the engine in accordance with this invention. Such a "supercharging" effect flows from the induction into the intake chamber of a charge of gas greater than can be contained within the combustion chamber under atmospheric pressure conditions. Thus, pressures within the combustion chamber preferably are always elevated above normal atmospheric pressure. Further, this illustrates an important characterizing feature of this invention in that the control and power pistons separate certain functions and cycle portions which heretofore were necessarily unified, permitting and accomplishing use of the control piston means for maximizing volumetric efficiency and of the power piston for stroke efficiency.

As the power piston means 12 moves from bottom dead center position toward top dead center position, the control piston means 15 completes the transfer stroke (FIG. 7) and begins a next following intake stroke (FIG. 8), with the cycle of operation then repeating.

Referring now more particularly to the graphs of FIG. 9, the sequence of operation there represented is typical of certain engines incorporating the features of the present invention. However, the specific details of relationship between the piston movement curves and thus among the portions of the cycle of operation is contemplated as being variable from the specific example illustrated. Thus, the following description of certain relationships is not to be deemed limiting on engines and engine operation as contemplated by this invention.

As illustrated, the position of the power piston means 12 has been plotted as a simple harmonic displacement curve 30 related to 360° of rotation of the crankshaft 14, with the bottom dead center position of the power piston means 12 occuring at 0° of crankshaft rotation, the top dead center position occuring at 180° of crankshaft rotation, and the bottom dead center position reoccuring at 360° of crankshaft rotation. The control piston means 15 moves from a bottom dead center position along a complex curve 31, leaving bottom dead center with the power piston means 12 and moving to top dead center position during approximately 120° of crankshaft rotation. The control piston means 15 further moves from top dead center position to bottom dead center position during approximately 240° of crankshaft rotation, leaving the top dead center position approximately 60° of crankshaft rotation before the power piston means moves through its top dead center position. As will be noted, the interconnecting means driving the control piston means 15 moves the same from the top dead center position at a first velocity as the power piston means moves toward its top dead center position, and at a slower velocity (with less slope to the upper line of the graph) as the power piston means moves through the top dead center position.

The graphs of FIG. 9 additionally include a combustion chamber volume curve 32, indicating the relative differential between the piston displacement curves of the upper portion of the graph. The combustion chamber volumetric curve indicates an unequal distribution of volumetric changes over the 360° of crankshaft rotation, providing for transfer and compression of a charge over intervals of approximately 70° of crankshaft rotation and 115° of crankshaft rotation, respectively. The combustion stroke and exhaust consume approximately 155° of crankshaft rotation and 20° of crankshaft rotation, respectively.

In the drawings and specification, there has been set forth a preferred embodiment of the invention, and although specific terms are employed, they are used in a generic and descriptive sense only and not for purposes of limitation.

That which is claimed is:

1. In an internal combustion engine having a cylinder, power piston means for defining with the cylinder a combustion chamber and reciprocable within the cylinder in a compression stroke and a combustion stroke, a crankshaft operatively connected with the power piston means for transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means interconnecting said crankshaft and said control piston means for moving said control piston means with said power piston means during a combustion stroke thereof and for maintaining said combustion chamber at substantially constant volume during said combustion stroke, exhaust means operatively communicating with said cylinder for venting gaseous products of combustion from said combustion chamber as said power piston means moves about a bottom dead center position, intake means operatively communicating with said cylinder for admitting gas into said intake chamber as said control piston means moves in the intake stroke, and transfer means in said control piston means for admitting gas from said intake chamber into said combustion chamber as said control piston means moves in the transfer stroke.

2. An engine according to claim 1 wherein said exhaust means comprises valve means operable in timed relation with movement of said power piston means in the combustion stroke, said intake means comprises valve means operable in timed relation with movement of said control piston means in the intake stroke, and said transfer means comprises valve means operable in response to pressure differentials between gas in said intake and combustion chambers.

3. In an internal combustion engine having a cylinder, power piston means for defining with the cylinder a combustion chamber and reciprocable within the cylinder in a compression stroke and a combustion stroke, a crankshaft operatively connected with the power piston means for moving said power piston means with simple harmonic motion between bottom dead center and top dead center positions and for transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means interconnecting said crankshaft and said control piston means for moving said control piston means and with complex motion between bottom dead center and top dead center positions with said power piston means during a combustion stroke thereof and for maintaining said combustion chamber at substantially constant volume during said combustion stroke, said crankshaft and said interconnecting means establishing a constant phase relationship between movement of said piston means to said positions.

4. An engine according to claim 3 wherein said crankshaft and said interconnecting means move said control piston means to its top dead center position in advance of movement of said power piston means to its top dead center position.

5. In an internal combustion engine having a cylinder, power piston means for defining with the cylinder a combustion chamber and reciprocable within the cylinder in a compression stroke and a combustion stroke, a crankshaft operatively connected with the power piston means for moving said power piston means with simple harmonic motion in the compression stroke from a bottom dead center position to a top dead center position and in the combustion stroke from the top dead center position to the bottom dead center position and for transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means interconnecting said crankshaft and said control piston means for moving said control piston means with complex motion in the transfer stroke from a bottom dead center position to a top dead center position and in the intake stroke from the top dead center position to the bottom dead center position with said power piston means during a combustion stroke thereof and for maintaining said combustion chamber at substantially constant volume during said combustion stroke, said crankshaft and said interconnecting means establishing a constant overlapping phase relationship among the strokes.

6. An engine according to claim 5 wherein said crankshaft and said interconnecting means move said control piston means in the transfer stroke in leading overlapping relation to movement of said power piston means in the compression stroke, and move said control piston means in the intake stroke in leading overlapping relation to movement of said power piston means in the combustion stroke.

7. In an internal combustion engine having a cylinder, power piston means for defining with the cylinder a combustion chamber and reciprocable within the cylinder in a compression stroke and a combustion stroke, a crankshaft operatively connected with the power piston means for moving said power piston means from a bottom dead center position to a top dead center position during 180° of crankshaft rotation and from the top dead center position to the bottom dead center position during 180° of crankshaft rotation and for transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means interconnecting said crankshaft and said control piston means for moving said control piston means from a bottom dead center position to a top dead center position during approximately 120° of crankshaft rotation and from the top dead center position to the bottom dead center position during approximately 240° of crankshaft rotation and with said power piston means during a combustion stroke thereof and for maintaining said combustion chamber at substantially constant volume during said combustion stroke, said crankshaft and said interconnecting means establishing a constant phase relationship between movement of said piston means to said positions.

8. An internal combustion engine in which successive intake, compression, combustion and exhaust of a gas are more efficiently accomplished and comprising a cylinder, power piston means for defining with said cylinder a combustion chamber and reciprocable within said cylinder in a compression stroke and a combustion stroke, a crankshaft operatively connected with the power piston means for transmitting power therefrom during the combustion stroke, said power piston means and said crankshaft cooperating for moving said power piston means with simple harmonic motion between bottom dead center and top dead center positions, control piston means for defining with said cylinder an intake chamber and for cooperating with said cylinder and said power piston means in defining said combustion chamber and reciprocable within said cylinder in a transfer stroke and an intake stroke, means interconnecting said crankshaft and said control piston means for reciprocating said control piston means in timed relation with reciprocation of said power piston means, said control piston means and said interconnecting means cooperating for moving said control piston means with complex motion between bottom dead center and top dead center positions, said crankshaft and said interconnecting means establishing a constant phase relationship between movement of said piston means to said positions and maintaining said combustion chamber at substantially constant volume during said combustion stroke, exhaust means operatively communicating with said cylinder for venting gaseous products of combustion from said combustion chamber as said power piston means moves about the bottom dead center position, intake means operatively communicating with said cylinder for admitting gas into said intake chamber as said control piston means moves in the intake stroke, and transfer means in said control piston means for admitting gas from said intake chamber into said combustion chamber as said control piston moves in the transfer stroke.

9. An engine according to claim 8 wherein said crankshaft and said interconnecting means cooperate for moving said control piston means from the bottom dead center position into the transfer stroke while moving said power piston means from the bottom dead center position into the compression stroke, and further wherein said crankshaft and said interconnecting means cooperate for moving said control piston means from the top dead center position into the intake stroke approximately 60° of crankshaft rotation before moving said power piston means from the top dead center position into the combustion stroke.

10. An engine according to claim 9 wherein said crankshaft and said interconnecting means cooperate for moving said control piston means from the top dead center position at a first velocity as said power piston means moves toward the top dead center position, and at a slower velocity as said power piston means moves through the top dead center position.

11. In a method of operating an internal combustion engine which comprises the steps of moving a control piston within a cylinder in timed relation to the rotation of a crank shaft and in an intake stroke and a transfer stroke between top dead center and bottom dead center positions while drawing a charge of gas into an intake chamber defined within the cylinder by the control piston and transferring the charge through the control piston into a combustion chamber defined within the cylinder between the control piston and a power piston, and moving the power piston within the cylinder in timed relation to rotation of the crank shaft in a compression stroke and a combustion stroke between top dead center and bottom dead center positions while compressing and burning the charge in the combustion chamber and driving the crank shaft in rotation for transmitting power from the engine during the combustion stroke of the power piston, the improvement comprising moving the power piston with simple harmonic motion between top dead center position and bottom dead center position while moving the control piston from top dead center position to bottom dead center position during approximately 240° of crank shaft rotation and from bottom dead center position to top dead center position during approximately 120° of crank shaft rotation, the movements of the control piston and the power piston maintaining the combustion chamber at substantially constant volume during the combustion stroke.

12. In a method of operating an internal combustion engine which comprises the steps of moving a control piston within a cylinder in timed relation to the rotation of a crank shaft and in an intake stroke and a transfer stroke between top dead center and bottom dead center positions while drawing a charge of gas into an intake chamber defined within the cylinder by the control piston and transferring the charge through the control piston into a combustion chamber defined within the cylinder between the control piston and a power piston, moving the power piston within the cylinder in timed relation to rotation of the crank shaft in a compression stroke and a combustion stroke between top dead center and bottom dead center positions while compressing and burning the charge in the combustion chamber and driving the crank shaft in rotation for transmitting power from the engine during the combustion stroke of the power piston, the improvement comprising moving the control piston from top dead center position into the intake stroke approximately 60° of crankshaft rotation before moving the power piston from top dead center position into the combustion stroke and moving the control piston from bottom dead center position into the transfer stroke while moving the power piston from bottom dead center position into the compression stroke, the movements of the control piston and the power piston maintaining the combustion chamber at substantially constant volume during the combustion stroke.

13. In a method of operating an internal combustion engine which comprises the steps of moving a control piston within a cylinder in timed relation to the rotation of a crank shaft and in an intake stroke and a transfer stroke between top dead center and bottom dead center positions while drawing a charge of gas into an intake chamber defined within a cylinder by the control piston and transferring the charge through the control piston into a combustion chamber defined within the cylinder between the control piston and a power piston, moving the power piston within the cylinder in timed relation to rotation of the crank shaft in a compressor stroke and a combustion stroke between top dead center and bottom dead center positions while compressing and burning the charge in the combustion chamber and driving the crank shaft in rotation for transmitting power from the engine during the combustion stroke of the power piston, the improvement comprising moving the power piston with simple harmonic motion between top dead center position and bottom dead center position while moving the control piston from top dead center position to bottom dead center position during approximately 240° of crank shaft rotation and from bottom dead center position to top dead center position during approximately 120° of crank shaft rotation.

14. In an internal combustion engine having a cylinder, power piston means for defining with the cylinder a combustion chamber and reciprocable within the cylinder in a compression stroke and a combustion stroke, a crankshaft operatively connected with the power piston means for moving said power piston means from a bottom dead center position to a top dead center position during 180° of crankshaft rotation and from the top dead center position to the bottom dead center position during 180° of crankshaft rotation and for transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means for interconnecting said crankshaft and said control piston means for moving said control piston means from a bottom dead center position to a top dead center position during approximately 120° of crankshaft rotation and from the top dead center position to the bottom dead center position during approximately 240° of crankshaft rotation, said crankshaft and said interconnecting means establishing a constant phase relationship between movement of said piston means to said positions.

15. In an internal combustion engine having a cylinder, power piston means for defining with the cylinder a combustion chamber and reciprocable within the cylinder for sweeping a predetermined displacement in a compression stroke and a combustion stroke, a crankshaft operatively connected with the power piston means for moving the same with simple harmonic motion while transmitting power therefrom during the combustion stroke, and control piston means for defining with the cylinder an intake chamber and for cooperating with the cylinder and the power piston means in defining the combustion chamber and operatively connected with the crankshaft for reciprocation in the cylinder in a transfer stroke and an intake stroke in timed relation with reciprocation of the power piston means, the improvement comprising means interconnecting said crankshaft and said control piston means for moving said control piston means with complex motion in timed relation to said power piston means and sweeping a displacement differing from said predetermined displacement so that pressures within the combustion chamber are varied from normal atmospheric pressure.

16. An engine according to claim 15 wherein said control piston swept displacement is greater than said predetermined displacement so that pressures within the combustion chamber are elevated above normal atmospheric pressure.

17. In a method of operating an internal combustion engine which comprises the steps of moving a control piston within a cylinder in an intake stroke and a transfer stroke between top dead center and bottom dead center positions while drawing a charge of gas into an intake chamber defined within the cylinder by the control piston and then transferring the charge through the control piston into a combustion chamber defined within the cylinder between the control piston and a power piston, moving the power piston in a compression stroke and a combustion stroke between top dead center and bottom dead center positions and in timed relation with movement of the control piston while compressing and burning the charge in the combustion chamber, and interconnecting the control and power pistons through a crankshaft while transmitting power from the engine by driving the crankshaft in rotation during a combustion stroke of the power piston, the improvement comprising maintaining the combustion chamber at substantially constant volume during the combustion stroke.

18. A method according to claim 17 further comprising sweeping a predetermined displacement with the power piston while sweeping a greater displacement with the control piston, and thereby elevating pressures within the combustion chamber above pressures within the intake chamber.

* * * * *

UNITED STATES PATENT AND TRADEMARK OFFICE

CERTIFICATE OF CORRECTION

PATENT NO. : 4,169,435

DATED : October 2, 1979

INVENTOR(S) : Edward L. Faulconer, Jr.

It is certified that error appears in the above-identified patent and that said Letters Patent are hereby corrected as shown below:

Column 1, Line 16 "combination" should be - combustion -

Column 1, Line 33 "to" should be - of -

Signed and Sealed this

*Twenty-second* Day of *April 1980*

[SEAL]

*Attest:*

SIDNEY A. DIAMOND

*Attesting Officer*

*Commissioner of Patents and Trademarks*